US012520926B1

(12) United States Patent
Morris

(10) Patent No.: US 12,520,926 B1
(45) Date of Patent: Jan. 13, 2026

(54) MOTORIZED LOTION APPLICATOR FOR A PERSON'S BACK

(71) Applicant: Inez Morris, Coral Springs, FL (US)

(72) Inventor: Inez Morris, Coral Springs, FL (US)

( * ) Notice: Subject to any disclaimer, the term of this patent is extended or adjusted under 35 U.S.C. 154(b) by 301 days.

(21) Appl. No.: 18/106,235

(22) Filed: Feb. 6, 2023

(51) Int. Cl.
*A45D 34/04* (2006.01)

(52) U.S. Cl.
CPC ..... *A45D 34/04* (2013.01); *A45D 2200/054* (2013.01); *A45D 2200/1081* (2013.01)

(58) Field of Classification Search
CPC ..... A45D 34/04; A45D 2200/054; A45D 2200/1081; A45D 2200/055; A45D 2200/10
USPC ..... 401/6, 261, 265
See application file for complete search history.

(56) References Cited

U.S. PATENT DOCUMENTS 5,573,342 A * 11/1996 Patalano ..... A45D 40/26 401/175
6,536,970 B2 * 3/2003 Hauser ..... A46B 11/0041 401/6
8,387,628 B2 * 3/2013 Bowie ..... A46B 11/0065 401/175
8,998,523 B1 * 4/2015 Muller ..... A45D 34/042 401/175
9,908,140 B2 * 3/2018 Arwatz ..... B65D 83/761
10,448,724 B1 10/2019 Wendland
11,503,897 B2 11/2022 Dyer
11,533,979 B1 * 12/2022 Rehan ..... A46B 11/0006

* cited by examiner

*Primary Examiner* — David J Walczak

(74) *Attorney, Agent, or Firm* — Sanchelima & Associates, P.A.; Jesus Sanchelima; Christian Sanchelima

(57) ABSTRACT

A motorized lotion applicator for a person's back including a body assembly, a hand assembly and an electronic assembly. The body assembly includes a rod and a compartment. The rod has a button and the compartment is within the rod. The container stores lotion. The hand assembly includes a hand-shaped applicator having dispensing openings. The hand-shaped applicator is attached to the rod. The electronic assembly includes a motor. The motor is connected to the container. The motor is actuated by depressing the button to force the container to dispense the lotion through the dispensing openings.

10 Claims, 3 Drawing Sheets

MOTORIZED LOTION APPLICATOR FOR A PERSON'S BACK

II. BACKGROUND OF THE INVENTION

1. Field of the Invention

The present invention relates to a motorized lotion applicator for a person's back and, more particularly, to a motorized lotion applicator for a person's back that allows applying lotion while massaging hard to reach areas.

2. Description of the Related Art

Several designs for lotion applicators have been designed in the past. None of them, however, include dispensing openings placed in a hand-shaped head to dispense a cream lotion therethrough.

Applicant believes that a related reference corresponds to U.S. Pat. No. 11,503,897 issued for a device for applying lotions or other fluid onto a person's back. Applicant believes that another related reference corresponds to U.S. Pat. No. 10,448,724 issued for a back cream applicator which has an elongated handle, a liquid reservoir, and an applicator head. None of these references, however, teach of a hand-shaped massaging device with an elongated handle which is configured to store and dispense a lotion or cream onto the hand-shaped massaging head allowing a user to massage and apply a lotion to a hard to reach area such as their back.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a motorized lotion applicator for a person's back that includes protruding members that are used to massage while applying a lotion through the applicator.

It is another object of this invention to provide a motorized lotion applicator for a person's back that includes at least one motor and batteries, where the at least one motor is actuated to dispense cream lotion through dispensing openings of the applicator.

It is still another object of the present invention to provide a motorized lotion applicator for a person's back that includes a refillable compartment which can be filled with different types of cream lotions.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 represents an isometric operational view of the present invention 10 being used to apply lotion cream 120 to the user's back 102.

FIG. 2 shows an isometric view of the present invention 10. The present invention 10 includes a body assembly 20, a hand assembly 40 and an electronic assembly 60.

V. DETAILED DESCRIPTION OF THE EMBODIMENTS OF THE INVENTION

Figure 1:
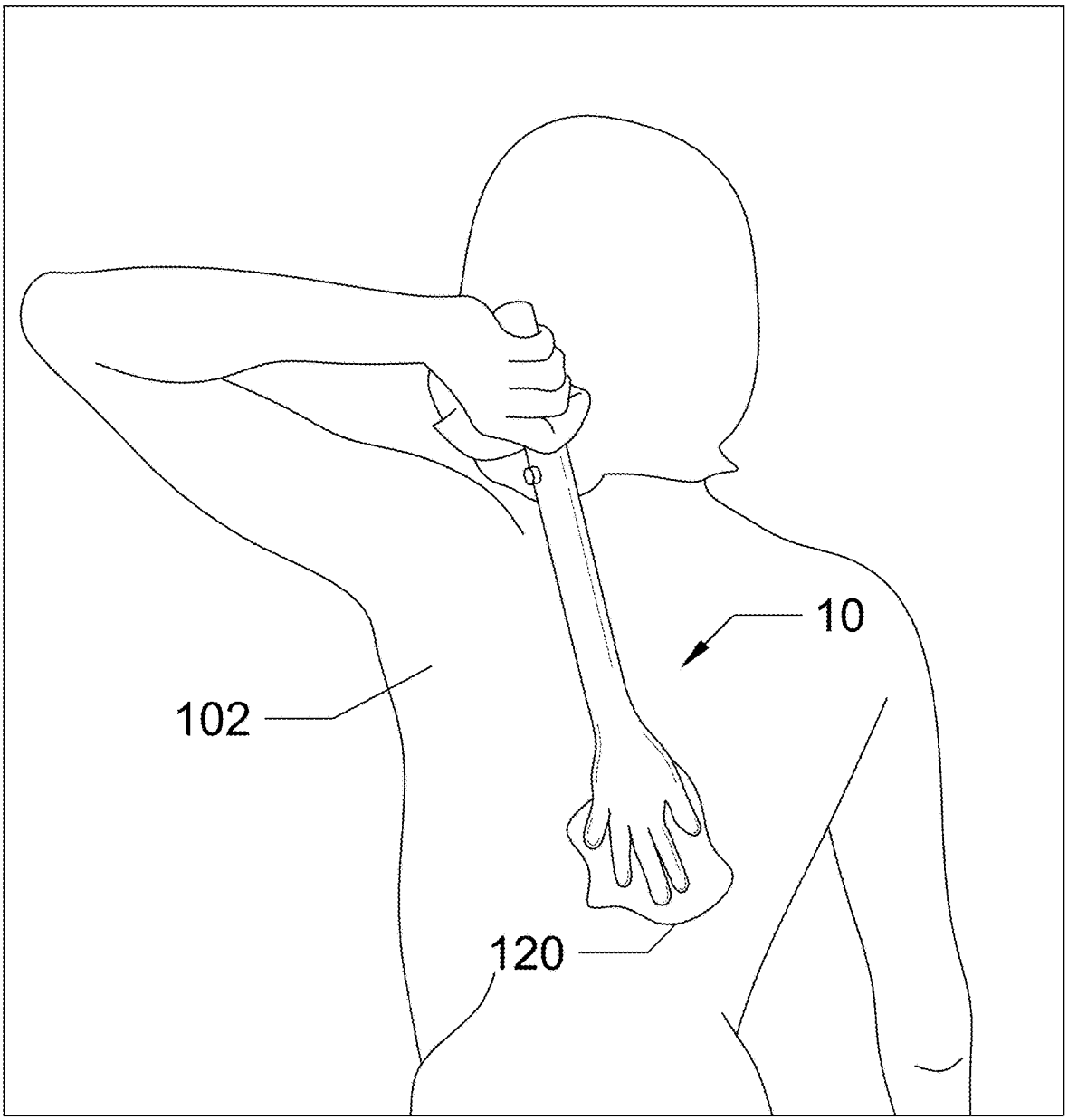
Figure 2:
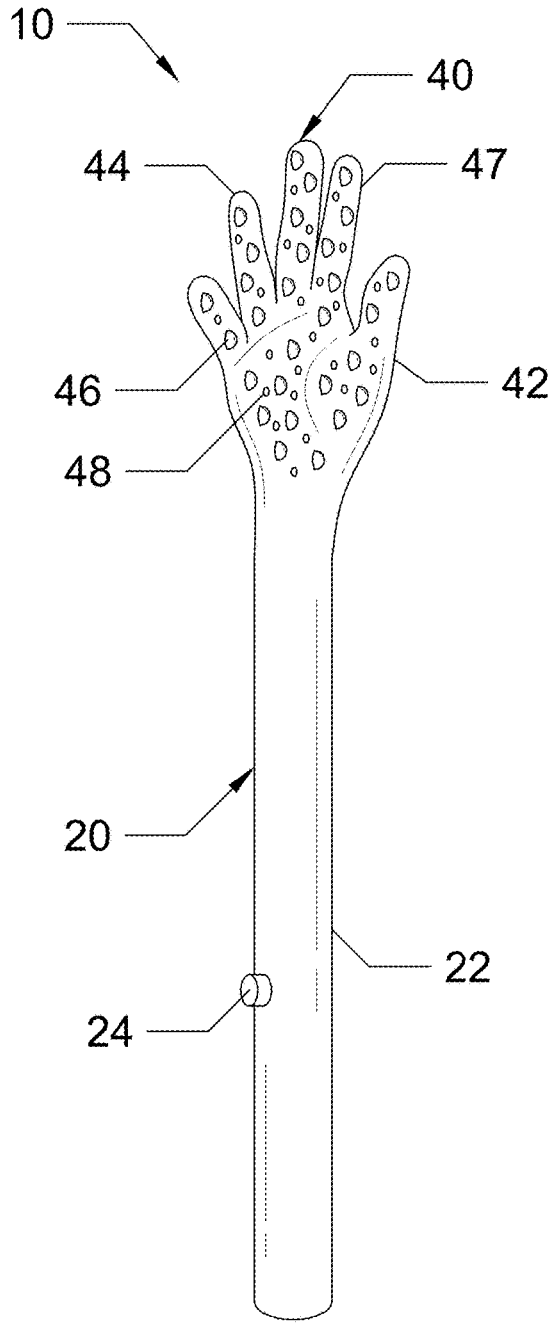

Referring now to the drawings, where the present invention is generally referred to with numeral 10, it can be observed that it basically includes a body assembly 20, a hand assembly 40 and an electronic assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The body assembly 20 may include a rod 22, a container 29 (also termed as a reservoir), and a button 24. The rod 22 may have a cylindrical shape. It also may be suitable for the rod 22 to have a rectangular shape, a triangular shape, or any other suitable shape. The rod 22 may be made of polyvinyl chloride, polyurethane, or any other suitable material. The rod 22 may be made of a soft and durable material. The button 24 may be in a central portion of the rod 22. A portion of the rod 22 may be hollow.

The rod 22 may enclose the container 29 and the electronic assembly 60. The container 29 may include a reservoir 27 and an endless screw 30 therein. The container 29 may be located on a top-inner portion of the rod 22. The endless screw 30 may be located on a bottom portion of container 29. The endless screw 30 may be located beneath the reservoir 27. The endless screw 30 may be operatively connected to the reservoir 27. The bottom end, also termed as movable base, of the reservoir 27 may be slidable through the reservoir 27. The reservoir 27 may be suitable to store cream lotion 120 therein. The reservoir 27 may have an open top end. The reservoir 27 may be hollow. The reservoir 27 may include a body and a head. The body of the reservoir 27 may have a cylindrical shape. The head of the reservoir 27 may have a conical shape. It also may be suitable for the reservoir 27 to have a rectangular shape, or any other suitable shape.

The endless screw 30 may be actuated to rotate. When the endless screw 30 rotates the bottom end of the reservoir 27 is pushed so lotion cream 120 moves from the body of the reservoir 27 to the head thereof through the open top end of the reservoir 27. The open top end of the reservoir 27 is connected to the hand assembly 40. The open top end of the reservoir 27 selectively opens or closes when applying a predetermined pressure thereto.

Figure 4:
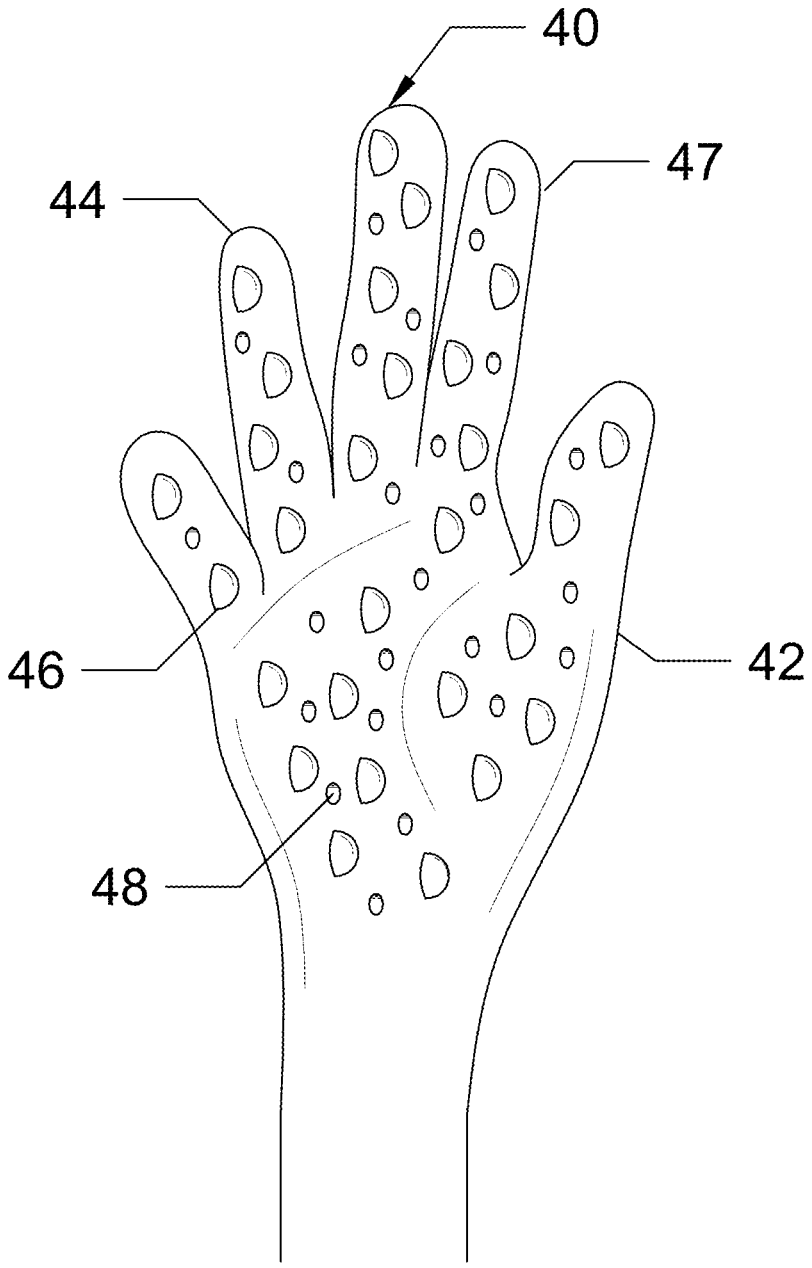
FIG. 4 is a representation of an enlarged view of the hand assembly 40 showing the protruding members 46.

As best illustrated in FIG. 4, the hand assembly 40 may include a hand-shaped dispenser 42, dispensing openings 48, protruding members 46. The hand-shaped dispenser 42 may be attached to the rod 22. The hand-shaped dispenser 42 may be made of polyethylene, rubber, or any other suitable material. The hand-shaped dispenser 42 may be made of an absorbent material. The hand-shaped dispenser 42 may conform with the shape of a human hand. The hand-shaped dispenser 42 may be hollow.

The protruding members 46 and the dispensing openings 48 may be equidistantly disposed on a front portion of the hand-shaped dispenser 42. The protruding members 46 may be used to massage the user's back. The protruding members 46 may have an hemispherical shape. It also may be suitable for the protruding members 46 to have a conical shape, an oval shape, or any other suitable shape. The protruding members 46 may be made of polyvinyl chloride, rubber sponge, fabrics, or any other suitable material. The dispensing openings 48 may have a circular shape. The lotion cream 120 stored within the reservoir 27 may be dispensed through the dispensing openings 48 when the endless screw 30 rotates moving the bottom end of the reservoir 27 up.

Figure 3:
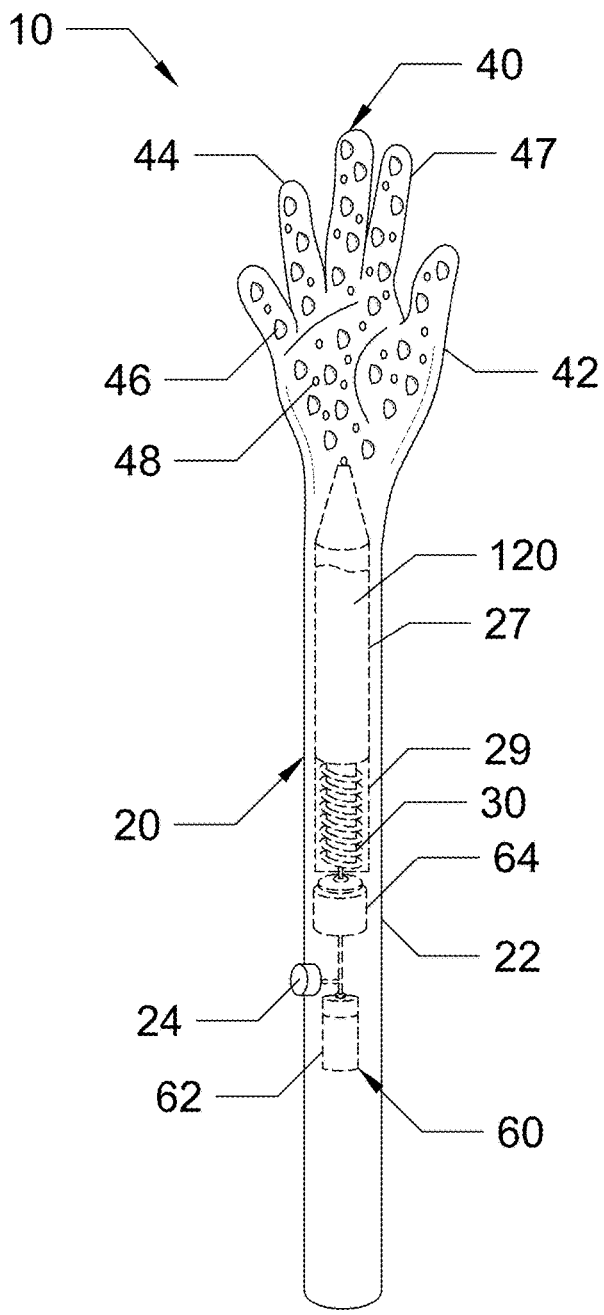
FIG. 3 illustrates a see-through view of the present invention 10 where electronic assembly 60 is observed.

Referring now to FIG. 3 it can be observed that the electronic assembly 60 may include at least one battery 62 and at least one motor 64. The at least one battery 62 and the at least one motor 64 may be within the rod 22 beneath the container 29. The at least one battery 62 may be alkaline batteries, nickel metal hydride batteries, lithium ion batteries, or any other battery known in the prior art. The at least one battery 62 may be a rechargeable battery. The at least one battery 62 may provide power to the at least one motor 64.

The at least one motor 64 may be operatively connected to the endless screw 30. The at least one motor 64 may be activated to rotate said endless screw 30 through depressing the button 24. In a preferred embodiment the button 24 is a push button. It should be understood that the rod 22 may include lids and openings to access to the at least one battery 62, to refill the reservoir 27 and so on.

In a preferred embodiment a user may hold the rod 22 and place the hand-shaped dispenser 42 on his back. The button 24 may be depressed to turn on the motor 64 so that lotion cream 120 is dispensed through the dispensing openings 48. The hand-shaped dispenser 42 may be used to distribute and scrub the back of the user.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A motorized lotion applicator for a person's back, comprising:

a body assembly, wherein said body assembly includes a rod and a reservoir, said rod having a button, said reservoir is within said rod, said reservoir is adapted to store a lotion thereinto and includes a body having a cylindrical shape and a head having a conical shape;

a hand assembly, wherein said hand assembly includes a hand-shaped applicator, said hand-shaped applicator having dispensing openings, said hand-shaped applicator is attached to said rod, wherein said dispensing openings are configured to dispense said lotion stored within said reservoir; and an electronic assembly, wherein said electronic assembly includes a motor, said motor is operatively connected to said reservoir, said motor is actuated by means of said button to force said reservoir to dispense said lotion through said dispensing openings.

2. The motorized lotion applicator for a person's back set forth in claim 1, wherein said reservoir includes a body and a head, said body stores lotion, said body having a movable base, said head having an open top end, wherein said open top end is operatively connected to said dispensing openings.

3. The motorized lotion applicator for a person's back set forth in claim 2, wherein said reservoir has an endless screw beneath said body, said endless screw is operatively connected to said movable base, said endless screw is actuated to rotate by means of said motor to slide said movable base through said body forcing said lotion to be dispensed through said open top end to the dispensing openings.

4. The motorized lotion applicator for a person's back set forth in claim 2, wherein said open top end is adapted to selectively open or close depending on a predetermined pressure applied thereto to control the flow of lotion to said dispensing openings.

5. The motorized lotion applicator for a person's back set forth in claim 1, wherein said electronic assembly includes at least one battery, wherein said at least one battery provides power to said motor, said at least one battery is a rechargeable battery.

6. The motorized lotion applicator for a person's back set forth in claim 1, wherein said electronic assembly is within said rod.

7. The motorized lotion applicator for a person's back set forth in claim 1, wherein said hand-shaped applicator includes protruding members, said protruding members having a hemispherical or conical shape, said protruding members protrude from said hand-shaped applicator.

8. The motorized lotion applicator for a person's back set forth in claim 7, wherein said dispensing openings and said protruding members are equidistantly disposed on a front face of said hand-shaped applicator.

9. A motorized lotion applicator for a person's back, comprising:

a body assembly, wherein said body assembly includes a rod and a reservoir, said rod having a button, said reservoir is within said rod, said reservoir includes a body and a head, wherein said body has a cylindrical shape and said head has a conical shape, said head having an open top end, wherein said body stores lotion therein, wherein said open top end is adapted to selectively open or close depending on a predetermined pressure applied thereto to control the flow of lotion, said body including an endless screw connected to a movable base of said body;

a hand assembly, wherein said hand assembly includes a hand-shaped applicator, said hand-shaped applicator having dispensing openings, wherein said open top end of said head is operatively connected to said dispensing openings, said hand-shaped applicator is attached to said rod, wherein said dispensing openings are configured to dispense said lotion stored within said body when said endless screw is actuated to rotate to move said movable base; and an electronic assembly, wherein said electronic assembly includes a motor, said motor is operatively connected to said endless screw, said motor is actuated by means of said button to rotate said endless screw forcing said lotion to be dispensed from said open top end to said dispensing openings.

10. A motorized lotion applicator for a person's back, consisting of:

a body assembly, wherein said body assembly includes a rod and a reservoir, said rod having a button, said reservoir is within said rod, said reservoir includes a body and a head, wherein said body has a cylindrical shape and said head has a conical shape, said head having an open top end, wherein said body stores lotion therein, wherein said open top end is adapted to selectively open or close depending on a predetermined pressure applied thereto to control the flow of lotion said body including an endless screw connected to a movable base of said body;

a hand assembly, wherein said hand assembly includes a hand-shaped applicator, said hand-shaped applicator having dispensing openings and protruding members, wherein said open top end of said head is operatively connected to said dispensing openings, said hand-shaped applicator is attached to said rod, wherein said dispensing openings are configured to dispense said lotion stored within said body when said endless screw is actuated to rotate to move said movable base, wherein said dispensing openings and said protruding members are equidistantly disposed on a front face of said hand-shaped applicator, wherein said protruding members have a hemispherical or conical shape, said protruding members protrude from said hand-shaped applicator; and an electronic assembly, wherein said electronic assembly includes a motor and at least one battery, said motor is operatively connected to said endless screw, said motor is actuated by means of said button to rotate said endless screw forcing said lotion to be dispensed from said open top end to said dispensing openings, wherein said at least one battery provides power to said motor, said at least one battery is a rechargeable battery.

* * * * *